US006574426B1

(12) United States Patent
Blanco, Jr.

(10) Patent No.: US 6,574,426 B1
(45) Date of Patent: Jun. 3, 2003

(54) IN-LINE TANKLESS INSTANTANEOUS ELECTRICAL RESISTANCE WATER HEATER

(76) Inventor: Byron Blanco, Jr., 30401 Marbella Vista, San Juan Capistrano, CA (US) 92675

( * ) Notice: Subject to any disclaimer, the term of this patent is extended or adjusted under 35 U.S.C. 154(b) by 0 days.

(21) Appl. No.: 10/298,507

(22) Filed: Nov. 18, 2002

(51) Int. Cl.[7] ..... F24H 1/10; H05B 3/78
(52) U.S. Cl. ..... 392/485; 392/490
(58) Field of Search ..... 392/465, 466, 392/474, 475, 476, 481, 485, 488, 489, 490

(56) References Cited

U.S. PATENT DOCUMENTS 4,602,145 A * 7/1986 Roberts ..... 392/496
5,277,152 A * 1/1994 Liao ..... 122/14.21
6,175,689 B1 1/2001 Blanco, Jr. ..... 392/485
6,240,250 B1 5/2001 Blanco, Jr. ..... 392/490

FOREIGN PATENT DOCUMENTS

DE 4111954 C1 * 3/1992 ..... F24H/9/20

* cited by examiner

*Primary Examiner*—Thor Campbell
(74) *Attorney, Agent, or Firm*—James G O'Neill

(57) ABSTRACT

An improved in-line tankless electrical resistance water heater includes removable brass bottom and top flanges to form an internal chamber in a tubular body. The top brass flange has a cold water inlet and a hot water outlet for connection to a hot water line. The water heater includes an internal passageway through which cold water travels into a flow sensing/heat element activating device and then into the internal chamber. An enlarged double-coiled heating element passes through the bottom flange and a bracket holds sealing elements firmly against connecting ends of the heating element to seal the connecting ends and firmly hold the heating element in place.

20 Claims, 3 Drawing Sheets

IN-LINE TANKLESS INSTANTANEOUS ELECTRICAL RESISTANCE WATER HEATER

BACKGROUND OF THE INVENTION

1. Field of the Invention

This invention relates generally to water heaters, and, more particularly, to an improved "instantaneous" in-line tankless, electrical resistance water heater, capable of operating at higher pressure.

2. Description of Related Art

Electrical resistance in-line water heaters are well known in the art. Examples of such water heaters are set forth in U.S. Pat. Nos. 6,175,689 and 6,240,250 to Byron Blanco, Jr. The Blanco, Jr. patents disclose unitary electrical resistance in-line tankless water heaters, having plastic bodies, and either one or two heating elements. The in-line tankless hot water heaters disclosed and claimed in the above-mentioned Blanco, Jr. patents provide improvements in the art, which are still useful today. However, the present invention provides an improved in-line tankless "instantaneous" water heater of a different configuration, improved efficiency and with a higher electrical rating, for use in place of or complementary to the hot water heaters disclosed in these Blanco, Jr. patents.

SUMMARY OF THE INVENTION

Accordingly, it is a general object of the present invention to provide an improved and simplified in-line tankless electrical resistance water heater of compact size. It is a particular object of the present invention to provide an improved continuous flow electrical resistance in-line tankless water heater, which can be easily installed and serviced. It is another particular object of the present invention to provide an improved in-line tankless electrical resistance water heater having a water-heating/holding compartment with an enlarged heating element sealingly held in a bronze bottom closure plate and extending into the water heating/holding compartment. It is yet another particular object of the present invention to provide an improved in-line tankless electrical resistance water heater for providing improved continuous flow of hot water, and which is instantaneously responsive to the demand for hot water and includes a sensor element at the top of a water-heating/holding compartment to more accurately measure the temperature of the water. And, it is still another particular object of the present invention to provide an improved in-line tankless electrical resistance water heater in which the incoming water flows through a dedicated passageway in a shorter housing, and which passageway has an anti-siphon opening therein, and wherein the housing includes a control device for operating a double-coil heating element having a higher electrical rating, immovably and sealingly held in a metallic end plate.

These and other objects of the present invention are achieved by providing an improved in-line tankless "instantaneous" electrical resistance water heater in which cold water enters a top inlet of a body and flows through a dedicated passageway formed in the body. The dedicated passage includes an anti-siphon opening to prevent accidents and cold water flowing through the passageway enters into two separate water chambers formed in a flow sensing/heat activating means and then with an inlet near a lower end of the body into a water-heating/holding compartment having an enlarged heating element therein. When a hot water faucet connected to an outlet of the water-heating/holding compartment is opened, the enlarged heating element is actuated to instantly heat the water in the compartment. When the hot water faucet is closed or shut off, the enlarged heating element is shut off.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

Figure 1:
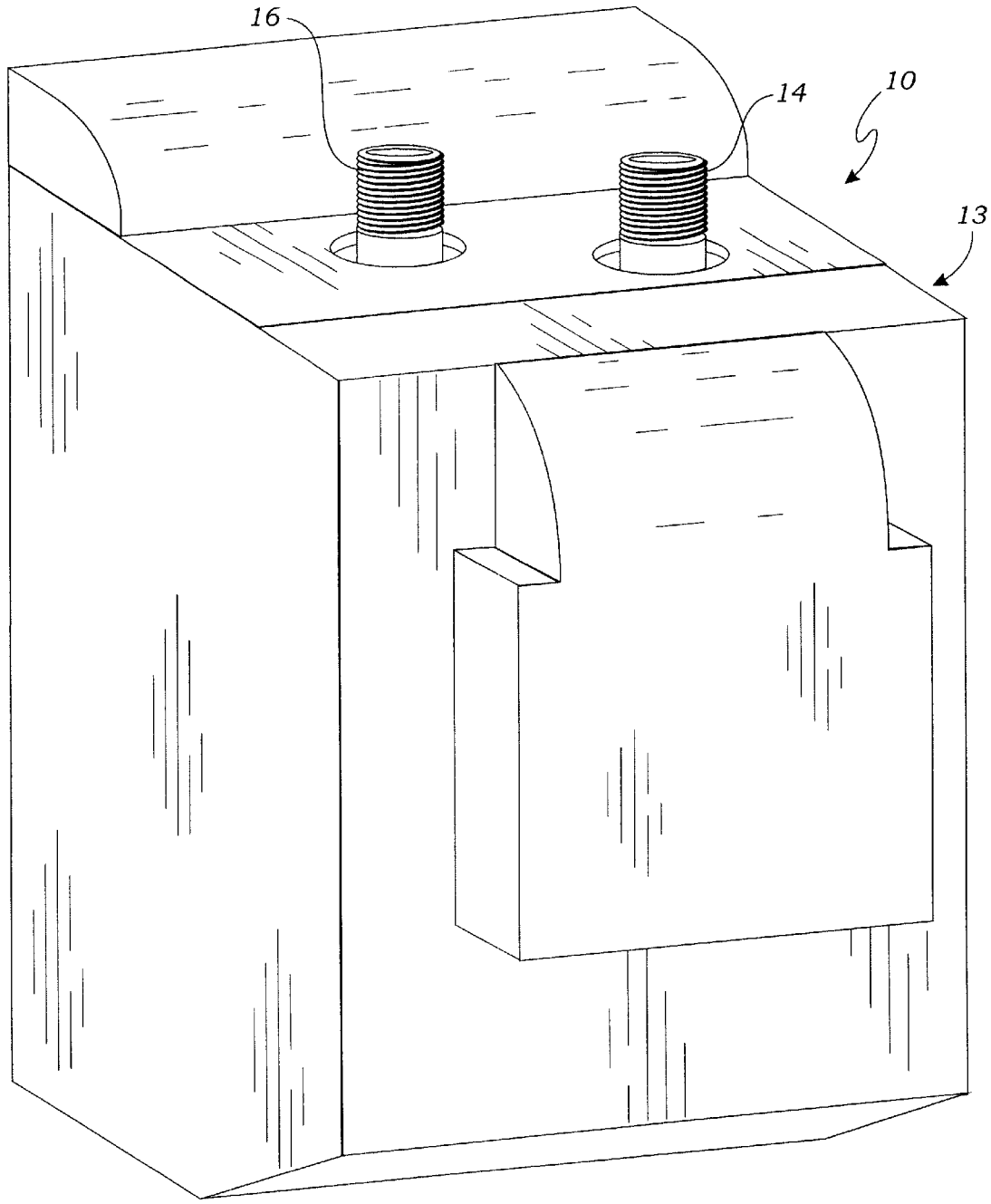
FIG. 1 is a front perspective view of a preferred embodiment of the improved in-line tankless electrical resistance water heater of the present invention, having a protective cover thereon.
Figure 2:
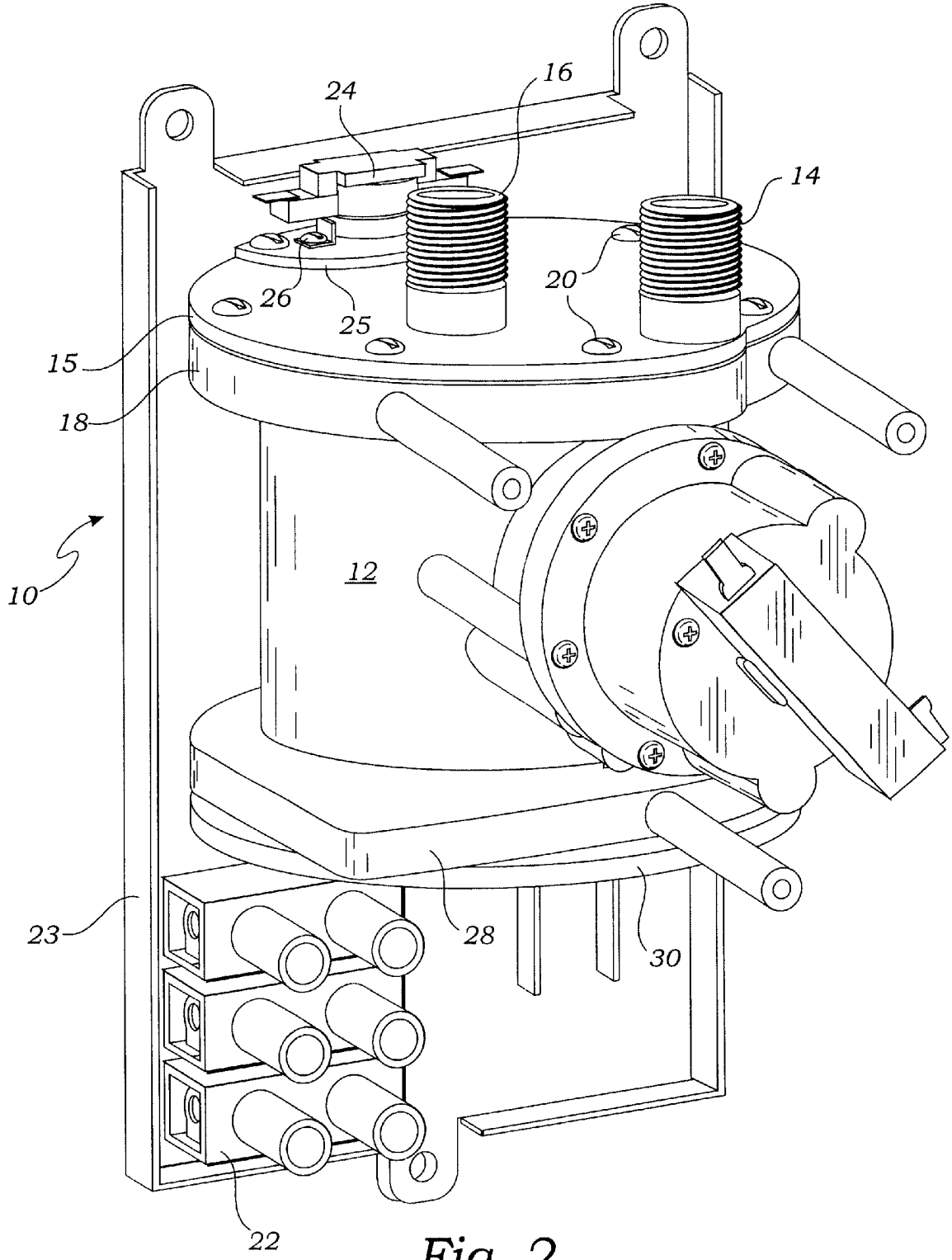
FIG. 2 is a further front perspective view of the water heater of the present invention with the protective cover removed.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified in-line tankless electrical resistance water heater generally indicated by the numeral 10. This water heater is for interconnection between an electrical power supply, a cold water inlet line and a hot water supply line, preferably against a wall near a shower, under a sink, or the like, to deliver hot water to an outlet.

As shown in the drawings, the improved water heater 10 of the present invention includes a body or housing 12, preferably made from a flame-retardant plastic, such as ZYTEL by Dupont and/or ABS manufactured by G.E. The body 12 may be molded or otherwise fabricated, in any desired size or shape, but is preferably formed as a tubular element having about the same diameter as it is high. For example, in a currently preferred embodiment the body 12 is about 3½ to 4 inches long and about 3½to 4 inches in diameter with a tubular open central portion approximately 2½ to 3 inches in diameter.

The water heater 10 includes an exterior protective shell or housing 13 removably mounted on and covering the body 12 (see FIG. 1). A metallic flange or top 15, preferably made from 100% lead-free brass or stainless steel, is releasably secured to the body 12 and includes a cold water inlet 14 and a hot water outlet 16, made of brass. The metallic flange or top 15 is releasably secured in place by a plurality of fastening elements 20, such as screws, or the like, captured in holding elements such as metal inserts (not shown), held in openings (not shown) formed around an enlarged top end 18 of the body 12. The metallic flange or top 15 is preferably grounded, as by means of ground wire (not shown) secured to the flange, as by means of a screw. The ground wire is preferably connected to a terminal block 22 mounted on a wall mounting or holding plate 23 secured to the body 12, preferably at a rear portion of the body.

In addition, a top surface of the flange 15 includes a sensor element or high-temperature limit switch or thermostat 24 mounted thereon. The high-temperature limit switch or thermostat 24 is connected to the terminal block 22 and is preferably in direct contact with an elevated or thicker portion 25 of the top surface, as by releasable holding means 26 to detect the highest temperature of the water being heated through the flange 15. The limit switch may also be connected to a separate sensing element (not shown) extending through the flange into an internal chamber 48.

The limit switch or thermostat 24 is preferably of the type that shuts off automatically at a preset temperature, for example about 135° F. The thermostat 24 also preferably has a top cut-off temperature, for example about 150° F. That is, if the water temperature in the internal chamber 48 reaches this cut-off temperature the thermostat will be permanently shut-off or disabled to prevent operation of a heating element 38.

An enlarged lower end 28 of the body 12 is closed off by a further metallic flange or bottom plate 30, which is also preferably 100% lead-free brass. The bottom flange is releasably secured to the body 12, in a manner similar to that described above for the top flange 15, as by means of screws 20 (see FIG. 3). A pair of openings 32 are formed in a central portion of the bottom plate 30 (see FIG. 3) and connecting ends 34, 36 of the heating element 38, which is preferably an enlarged, double coiled heating element having an increased electrical rating and higher energy efficiency, pass through these openings. The connecting ends 34, 36 are preferably sealed in the openings 32 by sealing elements 40, such as gaskets or O-rings, held in enlarged areas 42 formed around the openings 32, preferably in an elevated portion 44 formed on an interior surface of the flange 30. The sealing elements 40 are securely held in place by means of a bracket or holding element 46, which compresses or firmly seats the sealing elements in the enlarged areas by means of screws or the like 47, so as to firmly and immovably hold the ends 34, 36 of the enlarged, double-coiled heating element 38 in the metallic bottom plate 30.

The enlarged area 18 at the top end of the body 12 and the enlarged lower end 28 also include sealing elements (not shown), such as a gasket, O-ring, or the like, which may be held in an annular groove formed in the top and bottom surfaces of the enlarged ends of the body, to prevent water leakage.

By using metallic flanges, and, in particular, brass flanges secured at each end of the body 12, many advantages are obtained. For example, the device 10 will have a higher fire rating (UL-V05), and the water will not be contaminated. Furthermore, the total pressure of the water being heated in the inner chamber 48 formed in the body can be raised to about 500 psi, thus allowing more efficient use of energy.

Figure 3:
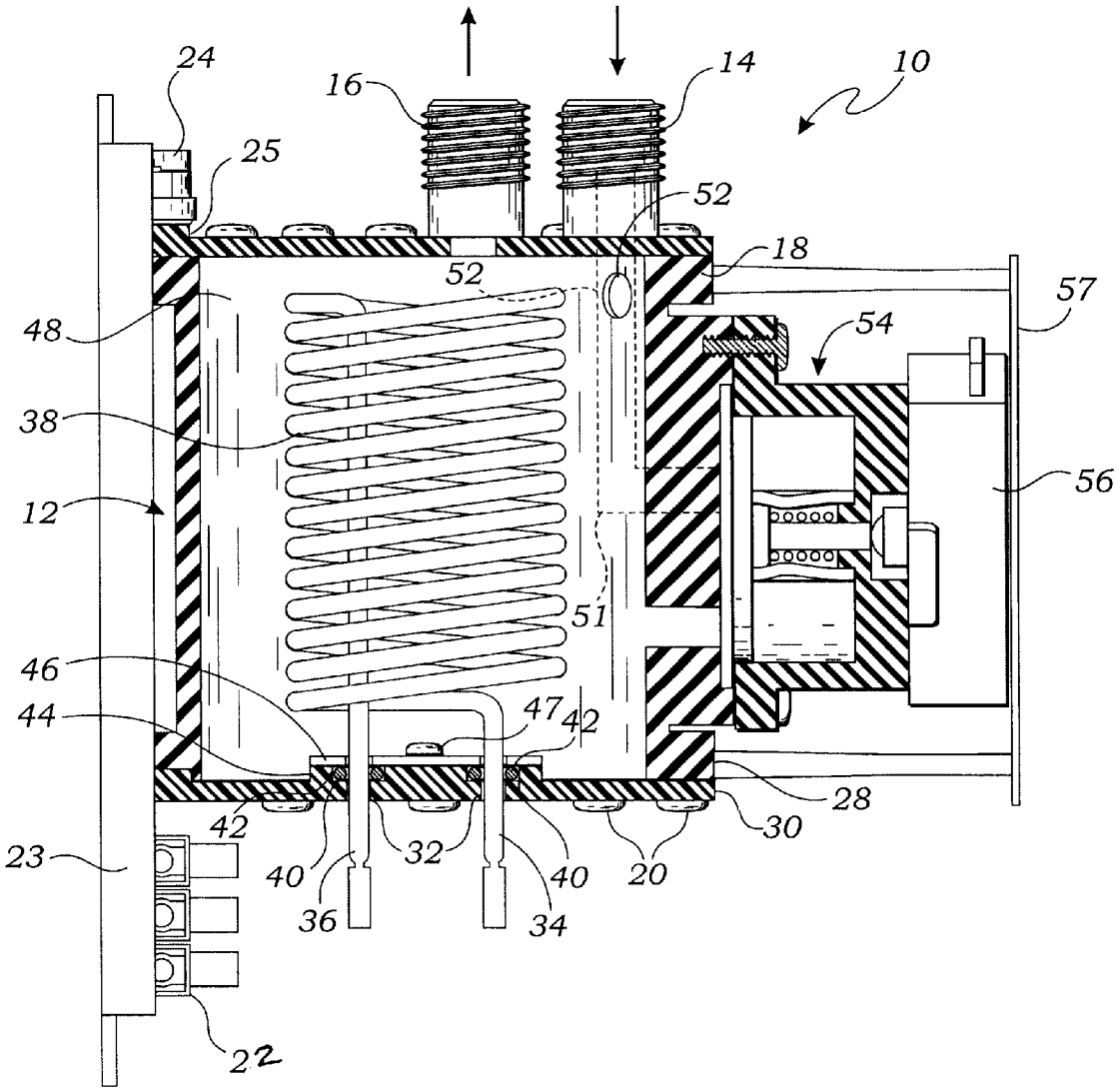
FIG. 3 is a partial cross sectional view of the water heater shown in FIG. 2.

Cold water entering the cold water inlet 14 flows through a dedicated water passageway 50 formed in the body 12, as shown in broken line in FIG. 3 at one side of the body 12. The water passageway 50 includes an anti-siphon opening 52 (shown enlarged for illustrative purposes only) near the enlarged top area 18. The water passageway 50 takes a 90° turn toward the central area of the body 12 so as to form a perpendicular passageway 51. As explained more fully in the U.S. Pat. Nos. 6,175,689 and 6,240,250 patents discussed above, the disclosures of which are incorporated herein in their entireties, cold water enters and operates a flow sensing/heat element activating means 54 having a micro switch. The micro switch 56 may be protected by a plate 57 secured to extending portions of the body 12.

Once the water heater 10 of the present invention is connected, for example, on a wall near a shower or under a sink, for example, between a water inlet line and a hot water faucet, and the hot water faucet is opened to allow water to flow from chamber 48 through an outlet 16, which outlet is enlarged to enable the water heater to be self cleaning, the pressure in the flow sensing/heat element activating means 54 activates the micro switch 56, to thereby apply power to the enlarged, double-coiled heating element 38 to instantaneously heat the water in chamber 48. When the hot faucet is closed, hot water will no longer exit the chamber 48 through the enlarged outlet 16, and the flow sensing/heat element activating means 54 will actuate the micro switch 56 to cut-off power to the heating element 38. The enlarged, double-coiled heating element has been specifically designed to be as energy efficient, as possible. For example, in a currently preferred embodiment, this compact heating element draws approximately 30 amps at 277 volts. The number of coils has been increased from known heating elements to about 13, in a more compact heating element. This heating element has an energy efficiency of approximately 99%, to produce superior and surprising results.

It is to be understood that the body 12 of the water heater 10 of the present invention is sized and dimensioned so that it may easily handle the water needs of a shower, to be easily handled and to be mounted in a vertical position by the mounting plate 23, which includes earthquake proof securing means. The water heater 10 works best with the inlet 14 and the enlarged outlet 16 in the vertical positions shown in the drawings. Furthermore, it is to be understood, that the protective and/or decorative cover or housing 13 should be placed over the water heater 10 so as to cover and protect the wiring, limit switch 24, the terminal block 22 and the microswitch 56. This housing, of course, has an opening (not shown) to allow a power supply, such as a power cord plugged into an electrical outlet to be inserted therein and connected to the terminal block 22, so as to allow operation of the water heater. This housing is also easily removable to allow access to the entire water heater for repair and testing.

It, therefore, can be seen that the present invention provides an improved tankless water heater, which delivers instant hot water upon actuation of a hot water faucet to which it is connected. The device includes an improved, highly energy efficient double coil heating element made from Incoloy steel having a unique sealing means for its connecting ends (34, 36) to hold the heating element in place, together with an anti-siphon opening in the water inlet passage.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An improved in-line tankless water heater for interconnection between an electrical power supply, a cold water inlet line and a hot water supply line; the water heater, comprising:

a substantially tubular body having an open central portion, an enlarged top and an enlarged bottom;

a thermostat mounted on an exterior surface of the substantially tubular body;

a first metallic flange removeably secured to the enlarged top and a second metallic flange removeably secured to the enlarged bottom to form an internal chamber;

a cold water inlet and a hot water outlet formed in the first metallic flange;

an elongated passage formed internally of the substantially tubular body in fluid communication between the cold water inlet and a water sensing/heat element activating means;

an enlarged, double-coiled heating element held in the internal chamber; and means for actuating a micro switch in the water sensing/heat activating means, to activate the enlarged, double-coiled heating element to substantially instantaneously heat water in the internal chamber.

2. The in-line tankless water heater of claim 1 wherein the enlarged, double-coiled heating element is sealingly captured in the second metallic flange.

3. The in-line tankless water heater of claim 2, further including a bracket secured to an inner surface of the second metallic flange and holding sealing means around connecting ends of the enlarged, double-coiled heating element extending through openings formed in the second metallic flange.

4. The in-line tankless water heater of claim 3 wherein the elongated passage formed internally of the elongated body includes an anti-siphon opening formed therein.

5. The in-line tankless water heater of claim 4 wherein the first metallic flange and the second metallic flange are made from brass.

6. The in-line tankless water heater of claim 5 wherein the brass is 100% lead free.

7. The in-line tankless water heater of claim 1 wherein the first metallic flange and the second metallic flange are made from 100% lead free brass.

8. The in-line tankless water heater of claim 7 wherein the enlarged, double-coiled heating element is immovably sealingly captured in the second metallic flange.

9. The in-line tankless water heater of claim 8, further including a bracket secured to an inner surface of the second metallic flange and holding sealing means around connecting ends of the enlarged, double-coiled heating element extending through openings formed in the second metallic flange.

10. The in-line tankless water heater of claim 9 wherein the elongated passage formed internally of the elongated body includes an anti-siphon opening formed therein and the hot water outlet includes an enlarged outlet opening to allow faster flow of water therethrough.

11. An improved in-line tankless water heater for interconnection between an electrical power supply, a cold water inlet line and a hot water supply line; the water heater, comprising:

a substantially tubular body having an open central portion, an enlarged top and an enlarged bottom;

a first brass flange removeably secured to the enlarged top and a second brass flange removeably secured to the enlarged bottom to form an internal chamber;

a brass cold water inlet and a brass hot water outlet secured in the first brass flange;

a thermostat mounted on an exterior surface of the first brass flange;

an elongated passage formed internally of the substantially tubular body in fluid communication between the cold water inlet and a water sensing/heat element activating means;

an enlarged, double-coiled heating element held in the first second brass flange and extending into the internal chamber; and means for actuating a micro switch in the water sensing/heat activating means, to activate the enlarged, double-coiled heating element to substantially instantaneously heat water in the internal chamber.

12. The in-line tankless water heater of claim 11, further including a bracket secured to an inner surface of the second brass flange and firmly holding sealing elements around connecting ends of the enlarged, double-coiled heating element extending through openings formed in a central portion of the second brass flange.

13. The in-line tankless water heater of claim 12 wherein the elongated passage formed internally of the elongated body includes an anti-siphon opening formed therein.

14. The in-line tankless water heater of claim 13 wherein the first brass flange and the second brass flange are 100% lead free.

15. The in-line tankless water heater of claim 11 wherein the first brass flange and the second metallic brass flange are 100% lead free.

16. The in-line tankless water heater of claim 15 wherein the enlarged, double-coiled heating element includes connecting ends that are sealingly captured in the second brass flange.

17. The in-line tankless, water heater of claim 16, further including a bracket secured to a raised portion formed on an inner surface of the second brass flange and holding sealing elements around connecting ends of the enlarged, double-coiled heating element extending through openings formed in the second metallic flange.

18. The in-line tankless water heater of claim 17 wherein the elongated passage formed internally of the elongated body includes an anti-siphon opening formed therein.

19. An improved in-line tankless water heater for interconnection between an electrical power supply, a cold water inlet line and a hot water supply line; the water heater, comprising:

a substantially tubular body having an open central portion, an enlarged top and an enlarged bottom;

a first 100% lead free brass flange removeably secured to the enlarged top and a second 100% lead free brass flange removeably secured to the enlarged bottom to form an internal water heating chamber;

a brass cold water inlet and a brass hot water outlet integrally formed with the first 100% lead free brass flange;

a thermostat mounted on a raised platform formed on an exterior surface of the first 100% lead free brass flange;

an elongated passageway formed internally of the substantially tubular body in fluid communication between the cold water inlet and a water sensing/heat element activating means;

an enlarged, double-coiled heating element sealing held by connecting ends in openings formed in a central portion of the second 100% lead free brass flange and extending into the internal chamber; and means for actuating a micro switch connected to the water sensing/heat activating means, to activate the enlarged, double-coiled heating element to substantially instantaneously heat water in the internal chamber.

20. The in-line tankless water heater of claim 19, further including a bracket secured to a raised portion formed on an inner surface of the second brass flange; the bracket acting to compress sealing elements held in enlarged areas around the openings to firmly hold the connecting ends in position.

* * * * *